US012352439B2

(12) United States Patent
Strader et al.

(10) Patent No.: US 12,352,439 B2
(45) Date of Patent: Jul. 8, 2025

(54) SYSTEMS FOR WATER HEATER BAFFLES ON RECREATIONAL VEHICLES

(71) Applicant: Haier US Appliance Solutions, Inc., Wilmington, DE (US)

(72) Inventors: Jacob Strader, La Grange, KY (US); Subbu Thenappan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 287 days.

(21) Appl. No.: 17/900,942

(22) Filed: Sep. 1, 2022

(65) Prior Publication Data

US 2024/0077203 A1 Mar. 7, 2024

(51) Int. Cl.

| | |
|---|---|
| ***F24H 1/06*** | (2022.01) |
| ***F23M 9/00*** | (2006.01) |
| ***F23M 9/08*** | (2006.01) |
| ***F28F 13/12*** | (2006.01) |
| *F24H 1/20* | (2022.01) |

(52) U.S. Cl.

CPC ..... *F23M 9/003* (2013.01); *F23M 9/08* (2013.01); *F28F 13/12* (2013.01); *F24H 1/20* (2013.01)

(58) Field of Classification Search

CPC ... F24H 1/06; F24H 1/08; F24H 1/165; F24H 1/205; F24H 1/206; F22B 17/16; F22B 7/06; F22B 7/12; F22B 9/12; F22B 13/04

See application file for complete search history.

(56) References Cited

U.S. PATENT DOCUMENTS

| | | | | |
|---|---|---|---|---|
| 1,859,745 | A * | 5/1932 | Morley | F24H 1/205 122/18.31 |
| 3,802,397 | A | 4/1974 | Wariner | |
| 4,771,762 | A * | 9/1988 | Bridegum | F24H 1/285 122/75 |
| 4,790,268 | A * | 12/1988 | Eising | F24H 1/206 122/49 |
| 5,960,157 | A * | 9/1999 | McGraw | G05D 23/1909 392/441 |
| 6,152,083 | A * | 11/2000 | Bridegum | F24H 1/285 122/87 |
| 7,277,627 | B2 * | 10/2007 | Hughes | F28D 20/0034 392/441 |
| 8,807,093 | B2 * | 8/2014 | Steinhafel | F24H 1/285 122/15.1 |
| 10,036,570 | B2 | 7/2018 | Zhang et al. | |
| 10,184,690 | B2 * | 1/2019 | Steinhafel | F24H 15/223 |

(Continued)

FOREIGN PATENT DOCUMENTS

| | | | |
|---|---|---|---|
| CN | 202952934 U | * | 5/2013 |
| CN | 208620588 U | * | 3/2019 |
| CN | 111380068 A | | 6/2022 |

*Primary Examiner* — Gregory A Wilson

(74) *Attorney, Agent, or Firm* — Dority & Manning, P.A.

(57) ABSTRACT

A water heater appliance for a recreational vehicle includes a tank and a flue disposed within the tank. The flue forms a U-shape that extends to and from an external side of the tank. A gas supply is in fluid communication with the flue. A burner assembly is disposed at an inlet of the flue. A baffle disposed within the flue. The baffle includes a plurality of restrictors configured to the baffle and the flue, and a flue collar mounted to the flue. The flue collar is configured to secure the baffle to the flue.

20 Claims, 3 Drawing Sheets

(56) References Cited

U.S. PATENT DOCUMENTS

| | | | | |
|---|---|---|---|---|
| 2010/0031900 | A1* | 2/2010 | Consadori | F23N 5/245 122/18.1 |
| 2012/0192812 | A1* | 8/2012 | Rahmani | F24H 9/0026 122/15.1 |

* cited by examiner

SYSTEMS FOR WATER HEATER BAFFLES ON RECREATIONAL VEHICLES

FIELD OF THE INVENTION

The present subject matter relates generally to recreational vehicle water heaters, and more particularly baffles therein.

BACKGROUND OF THE INVENTION

Water heaters for use with recreational vehicles (RV) typically include a water tank in combination with an internal heating element. Most internal heating elements in water heaters used in RV are dual fuel: liquid petroleum gas and electric heating. The water heater is mounted on the recreational vehicle in a convenient position connected to cold water supply and hot water outlet pipes, respectively receiving cold water from a suitable water supply source and for directing heated water for use in cooking, bathing, and the like. In a standard RV water heater, the tank has a cylindrical shape is normally mounted on the vehicle for convenient access through a hinged door or the like to control components like a control valve, drain plug, etc. When using the gas heating system of the water heater, the current industry design uses a completely open flue tube.

BRIEF DESCRIPTION OF THE INVENTION

Aspects and advantages of the invention will be set forth in part in the following description, or may be apparent from the description, or may be learned through practice of the invention.

In one example embodiment, a water heater appliance for a recreational vehicle includes a tank and a flue disposed within the tank. The flue forms a U-shape extending to and from an external side of the tank. A burner assembly is disposed at an inlet of the flue. A baffle is disposed within the flue. The baffle includes a plurality of restrictors extending to the flue, and a flue collar configured to secure the baffle to the flue.

In another example embodiment, a water heater appliance for a recreational vehicle includes a tank and a flue disposed within the tank. The flue forms a U-shape that extends to and from an external side of the tank. A burner assembly is disposed at an inlet of the flue, and a gas supply is in fluid communication with the inlet of the flue. A baffle is disposed with the flue. The baffle includes a helical shape that is configured to direct exhaust from the burner assembly in a spiral motion through the flue. A plurality of restrictors is configured to immobilize the baffle within the flue. A flue collar is mounted to the flue and is configured to secure the baffle to the flue.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
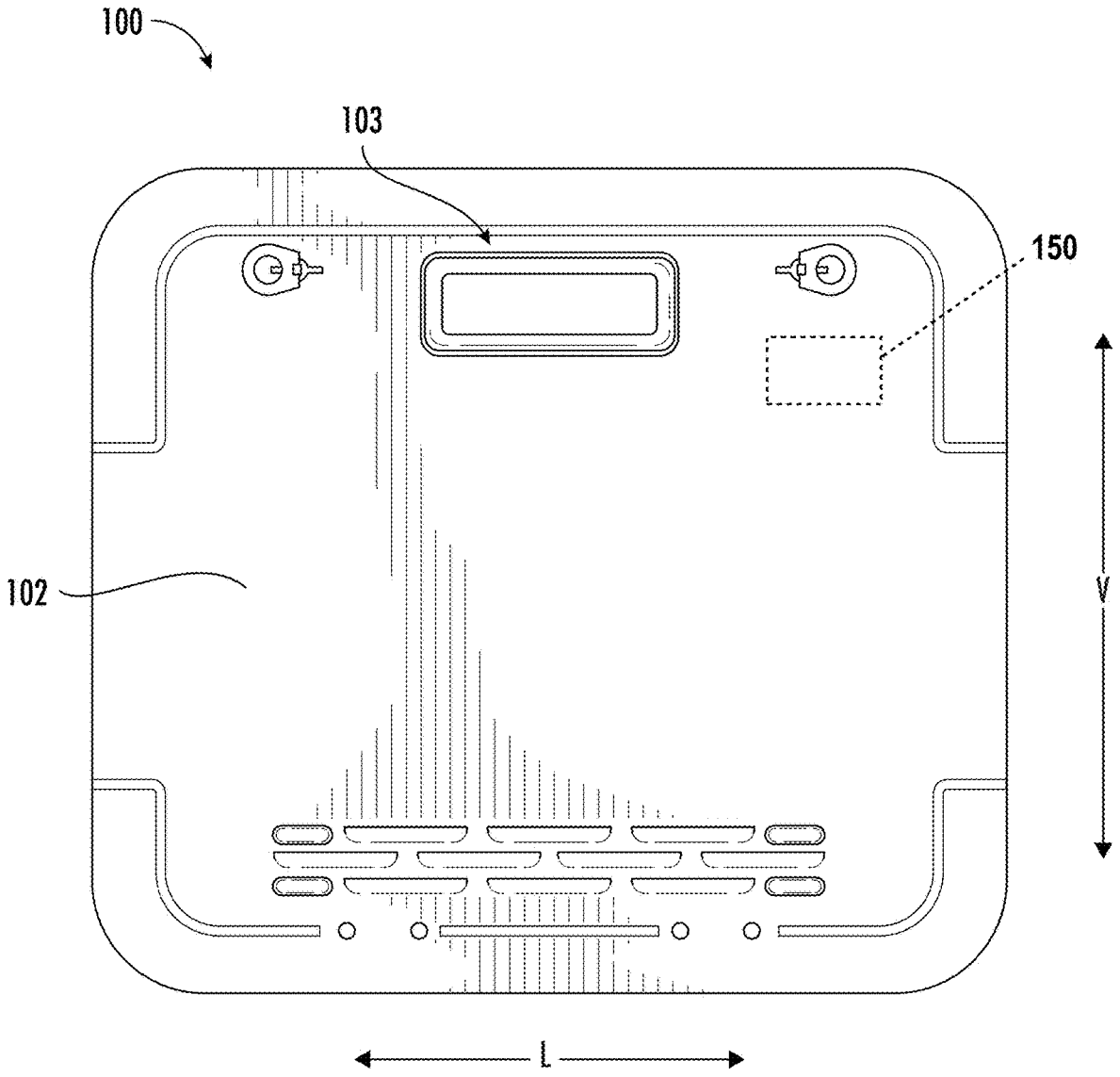
FIG. 1 provides a front view of an example embodiment of a water heater appliance for a recreational vehicle.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified.

Figure 2:
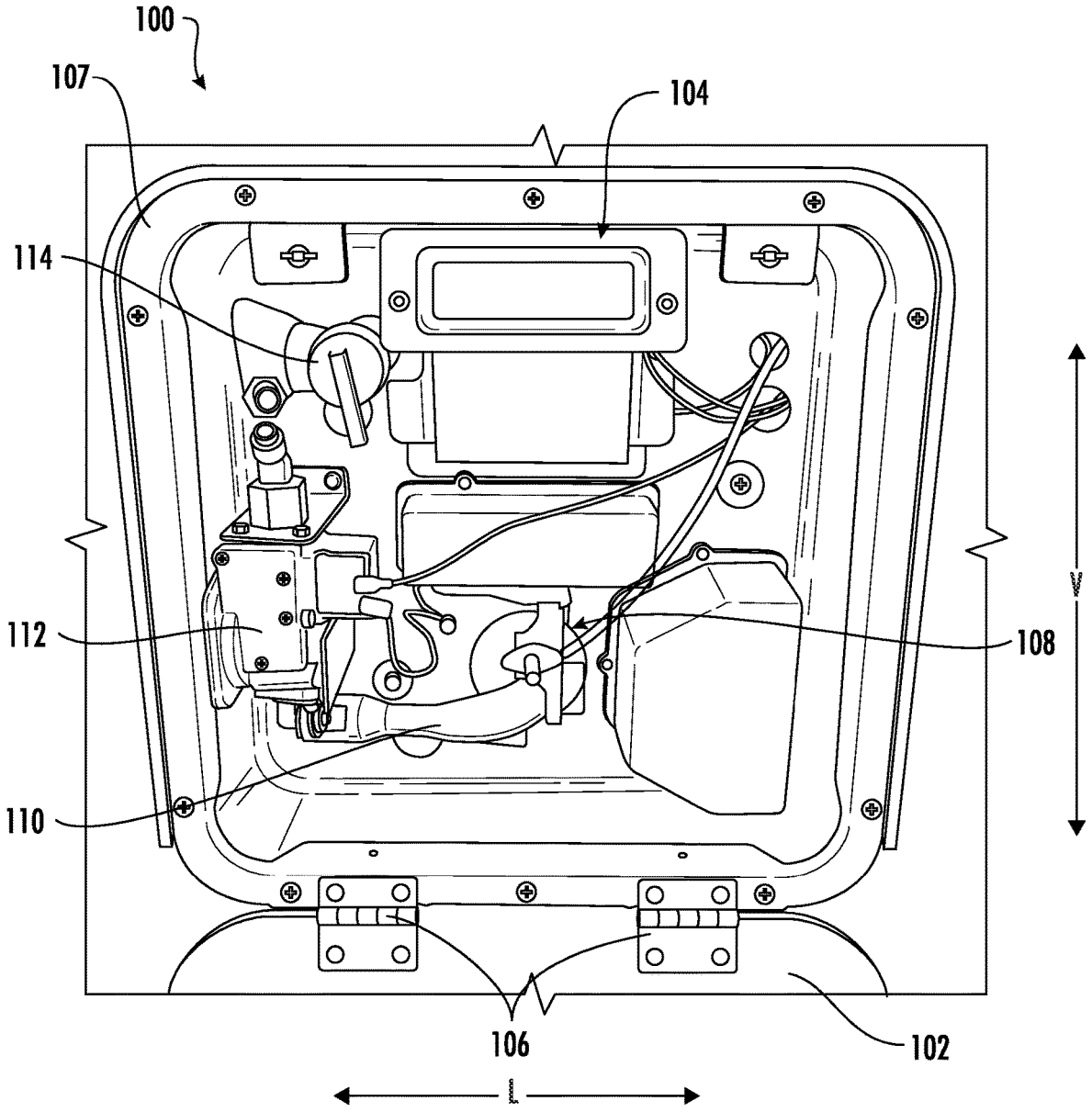
FIG. 2 provides a front view of the example water heater appliance of FIG. 1 with a panel in an open position.
Figure 3:
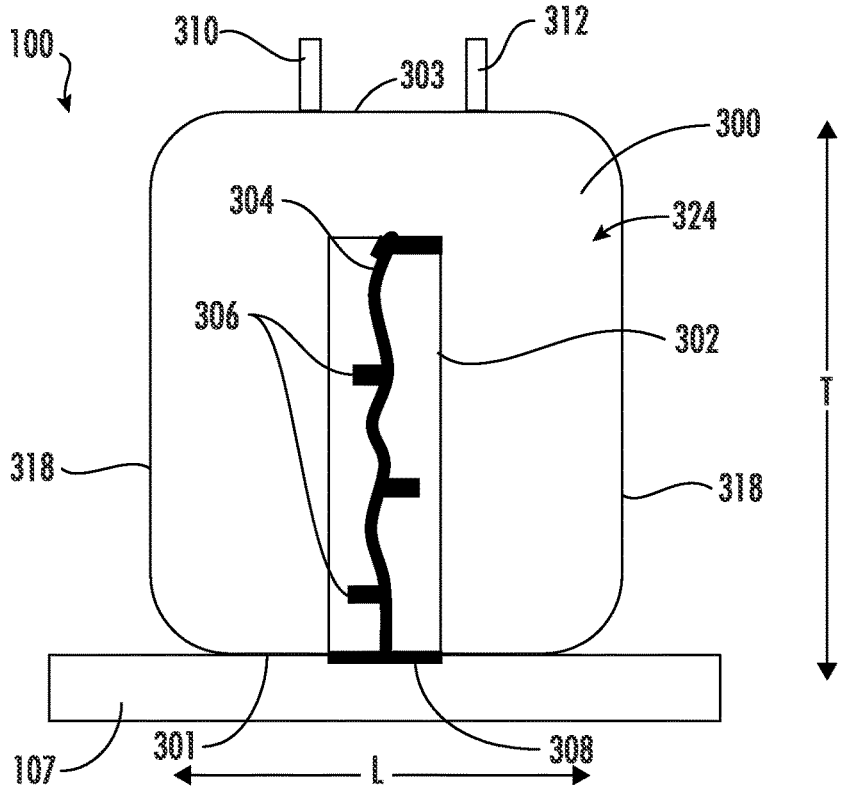
FIG. 3 provides a schematic view of certain components of the example water heater appliance of FIG. 1.
Figure 4:
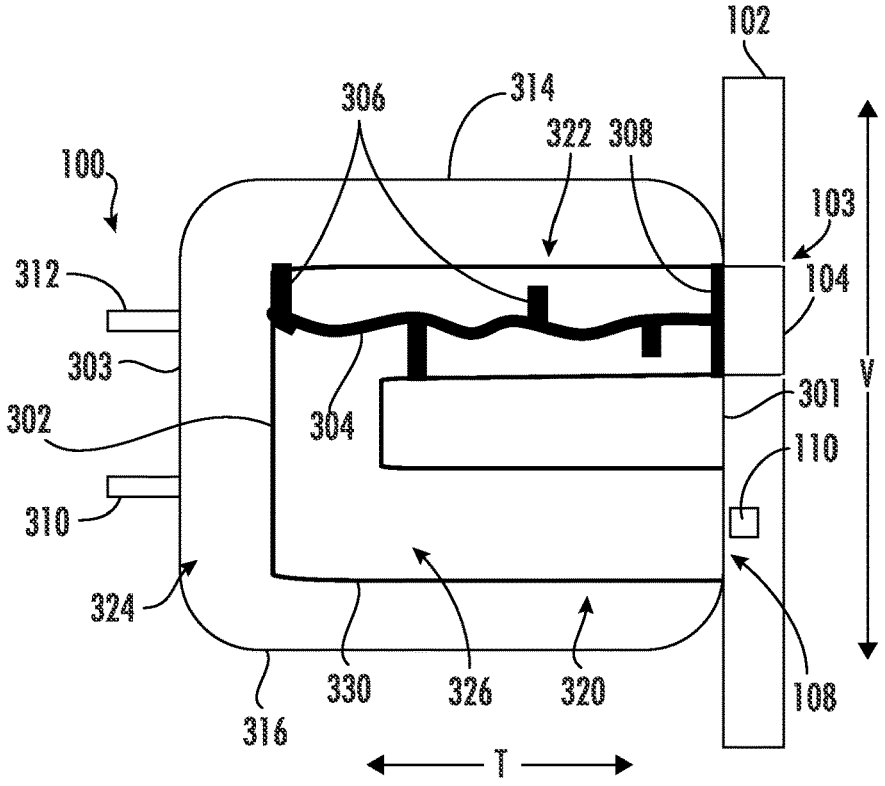
FIG. 4 provides another schematic view of certain components of the example water heater appliance of FIG. 1.

FIGS. 1 and 2 illustrate a front view of an example embodiment of a water heater appliance 100. Water heater 100 may include a panel, e.g., a door 102, as shown in FIG. 1 in a closed position. Door 102 of water heater 100 is shown in an open position in FIG. 2. In the present example embodiment, water heater 100 may be a dual fuel water heater. Thus, e.g., water heater 100 may be configured for heating water by either combusting liquid petroleum gas, such as liquid propane (LP), or by electrical heating via an electrical heating element (not shown). As seen in FIGS. 1 through 4, door 102 of water heater 100 may include a slot, such as an exhaust port 103 for an exhaust outlet 104 of a flue 302 (FIGS. 3 and 4). Referring further to FIG. 2, a hinge 106 may rotatably couple door 102 to a housing or frame 107. Opening door 102 about hinge 106 may permit access to internal components within frame 107, such as a tank 300 and flue 302 (FIGS. 3 and 4). Tank 300 and flue 302 will be described further herein in the context of FIGS. 3 and 4. Water heater 100 may also include a burner assembly 110 inside of frame 107 at an inlet 108 of flue 302. Burner assembly 110 may create combustion products, such as exhaust gases, that may exit water heater 100 through exhaust outlet 104 to ambient atmosphere. Burner assembly 110 may be in fluid communication with a gas control valve 112 such that gas control valve 112 may be used to control the flow of gas to burner assembly 110. Additionally, a pressure relief valve 114 and a drain valve (not shown) may be disposed within frame 107.

Water heater appliance 100 may further include a controller 150 that is configured for regulating operation of water heater appliance 100. Controller 150 is in, for example, operative communication (e.g., electrical communication through one or more conductive wires/busses) with burner assembly 110, the electrical heating element, and temperature sensors (not shown). Thus, controller 150 may selectively activate burner assembly 110 and/or the electrical heating element in order to heat water within an interior volume 324 of tank 300. As an example, controller 150 may activate/deactivate burner assembly 110 and/or the electrical heating element in response to signals from the temperature sensors. The signals from the temperature sensors may be analyzed by controller 150 to determine the temperature of the water within interior volume 324 of tank 300.

In some example embodiments, controller 150 includes memory (e.g., non-transitive media) and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Referring now to FIGS. 3 and 4, schematic views of certain components of water heater 100 are provided. Tank 300 may be coupled to frame 107 at an external side 301 of tank 300. As shown, an interior volume 324 defined by tank 300 extends transversely, in a transverse direction T, between external side 301 and internal side 303, laterally, along a lateral direction L, between side portions 318, and vertically, along a vertical direction V, between a top portion 314 and a bottom portion 316. Interior volume 324 of tank 300 may be sized for containing a volume of water suitable for a recreational vehicle water heater appliance in which water heater 100 is installed.

Flue 302 may extend within frame 107 and tank 300 in the form of a U-shape that extends to and from the external side 301 of tank 300. Flue 302 may have a cylindrical cross-sectional shape, e.g., a flue tube, through which exhaust gas may flow. Flue 302 may have a diameter of up to thirty (30 cm). In some example embodiments, flue 302 may have other cross-sectional shapes, such as rectangular, cylindrical, square, or any combination thereof. In the present example embodiment, as shown in FIG. 2, flue 302 includes a cylindrical inlet 108 and a rectangular exhaust port 103 and exhaust outlet 104. Flue 302 may be disposed such that inlet 108 of flue 302 is positioned vertically below exhaust outlet 104, e.g., with a bottom flue portion 320 and a top flue portion 322. As shown, flue 302 may have an interior volume 326 defined by an outer flue wall 330. Exhaust gas from burner assembly 110 may flow through flue 302 within interior volume 326. Conductive heat transfer may occur from the exhaust gas of burner assembly 110 to the outer flue wall 330 to heat the water in tank 300.

A baffle 304 may extend through flue 302. Baffle 304 may be a vane or a panel positioned in flue 302 in order to restrict and direct the flow of the combustion products, e.g., exhaust gas, from burner assembly 110. Baffle 304 may be helically shaped, e.g., as a helical vane or corkscrew, such that the baffle 304 may influence the exhaust gas from burner assembly 110 into a spiral flow path through flue 302. The influenced behavior of the exhaust provided by baffle 304 may permit greater heat transfer from the exhaust to flue 302 than the conventional open flue design, without baffle 304. Moreover, baffle 304 may be configured to redirect gas flow through flue 302 to change a flow path of the gas through flue 302 relative to when flue 302 is open and does not include baffle 304. As shown, baffle 304 may be disposed within top flue portion 322. Additionally or alternatively, baffle 304 may extend through both, or either of, top flue portion 322 and bottom flue portion 320. In other example embodiments there may be multiple baffles spaced throughout flue 302.

Since water heater 100 is a recreational vehicle water heater appliance, water heater 100 may undergo various motions as the recreational vehicle is operated by a user. Motion for a water heater appliance is atypical, relative to other water heaters domestically installed in houses, apartments, office buildings, or other buildings of the like. In order to hold and/or secure baffle 304 within flue 302, baffle 304 may include a plurality of restrictors 306 coupled to both baffle 304 and flue 302. The plurality of restrictors may aid in further restricting and directing the flow of the combustion products from burner assembly 110. The plurality of restrictors 306 may restrain baffle 304 from moving in each direction, e.g., one or more of laterally, L, vertically, V, and transversely, T, within flue 302 by contacting outer flue wall 330 within interior volume 326 of flue 302.

For increased rigidity, the plurality of restrictors 306 may be positioned and extend perpendicular to baffle 304 with respect to the helical shape of baffle 304, e.g., the baffle 304 may have a broad side (not shown) on which the plurality of restrictors 306 are positioned, thus securely holding baffle 304 within flue 302. Additionally or alternatively, the plurality of restrictors 306 may be disposed at any point along baffle 304 in order to secure baffle 304 in place. In certain example embodiments, the plurality of restrictors 306 may include as few as two (2) restrictors or as many as fifteen (15) restrictors. Further, each restrictor of the plurality of restrictors 306 may be positioned between three centimeters (3 cm) and thirty centimeters (30 cm) from another adjacent restrictor along a length of baffle 304. In addition to securing baffle 304 to flue 302, each restrictor of the plurality of restrictors 306 may also permit additional heat transfer to flue 302. Individually and in-combination, the increased heat transfer influenced by the helical shape of baffle 304 and heat transfer from the plurality of restrictors 306 may lead to an overall increase in the thermal efficiency of water heater 100. Additionally, the combination of baffle 304 and restrictors 306 may reduce the stand-by heat loss of water heater appliance 100 when water heater appliance 100 is between cycles or heating tank 300 with only the electrical heating element.

In order to further secure baffle 304 to flue 302, a flue collar 308 of baffle 304 may be coupled to frame 107. Additionally or alternatively, flue collar 308 may be coupled directly to flue 302. As shown, baffle 304 may be positioned within top flue portion 322, thus flue collar 308 may at least partially define exhaust outlet 104. Flue collar 308 may be mounted to either frame 107 or flue 302 using fasteners, e.g., screws, bolts, or the like. Alternatively, flue collar 308 may be welded to either frame 107 or flue 302. Thus, with both flue collar 308 and the plurality of restrictors 306, water heater 100 may undergo various motions as the recreational vehicle is operated by the user, and baffle 304 may be immobilized within flue 302. In certain example embodiments, flue collar 308 may be a plate or panel that extends across a width of the flue 302 at or proximate exhaust port 103 and which is perforated or includes opening(s) to form exhaust outlet 104.

Referring still to FIGS. 3 and 4, a water inlet 310, e.g., a cold-water inlet, may be connected to a pressurized water supply, such as a well or municipal water system. A water outlet 312, e.g., a hot-water outlet, may be connected to a downstream water consumption fixture within the RV, such as a dishwasher, hand-washing sink, shower, etc. When cold water flows into tank 300 from water inlet 310, heat may be transferred from the exhaust products through outer flue wall 330 to the water in tank 300 in order to raise the water temperature to a desired temperature. Thus, for example, when the dishwasher of the RV, in communication with controller 150, calls for hot water, the heated water of tank 300 flows out through water outlet 312.

As may be seen from the above, water heater 100 may include flue 302 disposed within tank 300. Flue 302 may include a helical shaped baffle 304 that may swirl exhaust gas from burner assembly 110 through flue 302. The rotation of the exhaust gas may spread heat around tank 300 and provide more heat transfer to the water than the traditionally used open flue. Additionally, to hold baffle 304 within flue 302 the plurality of restrictors 306 are used. The plurality of restrictors may further aid in the restriction of baffle 304 and in the directing of the flow of combustion products from burner assembly 110. Thus, individually and in-combination, the increased heat transfer influenced by the helical shape of baffle 304 and heat transfer from the plurality of restrictors 306 in flue 302 may lead to an overall increase in the thermal efficiency of water heater 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance for a recreational vehicle, comprising:

a tank comprising a cold-water inlet and a hot-water outlet;

a flue disposed within the tank, the flue forming a U-shape extending to and from an external side of the tank;

a burner assembly disposed at an inlet of the flue; and a baffle disposed within the flue, the baffle comprising, a plurality of restrictors extending to the flue, and a flue collar configured to secure the baffle to the flue, wherein the external side of the tank comprises a panel, the panel rotatable between an open position and a closed position, the panel comprising a slot for an exhaust outlet of the flue.

2. The water heater appliance of claim 1, wherein the baffle defines a helical shape and is configured to direct exhaust from the burner assembly in a spiral flow path through the flue.

3. The water heater appliance of claim 2, wherein the restrictors are arranged on the baffle and configured to locate and fix the baffle axially in the flue.

4. The water heater appliance of claim 1, wherein the flue collar is fixed to the baffle and mounted to an end of the flue.

5. The water heater appliance of claim 1, wherein the restrictors contact the flue and are configured for conductively transferring heat to the flue.

6. The water heater appliance of claim 5, wherein the conductive heat transfer from the restrictors heats water in the tank.

7. The water heater appliance of claim 1, wherein the restrictors limit motion of the baffle within the flue.

8. The water heater appliance of claim 1, further comprising an electrical heating element.

9. The water heater appliance of claim 8, wherein the baffle and the restrictors reduce stand-by heat loss when the water heater appliance is one or more of between cycles and heating via only the electrical heating element.

10. A water heater appliance for a recreational vehicle, comprising:

a tank comprising a cold-water inlet and a hot-water outlet;

a flue disposed within the tank, the flue forming a U-shape extending to and from an external side of the tank;

a burner assembly disposed at an inlet of the flue;

a gas supply in fluid communication with the inlet of the flue; and a baffle disposed with the flue, the baffle comprising, a helical shape configured to direct exhaust from the burner assembly in a spiral motion through the flue, a plurality of restrictors configured to immobilize the baffle within the flue, and a flue collar mounted to the flue, the flue collar configured to secure the baffle to the flue, wherein the external side of the tank comprises a panel, the panel rotatable between an open position and a closed position, the panel comprising a slot for an exhaust outlet of the flue.

11. The water heater appliance of claim 10, wherein the restrictors are arranged on the baffle and configured to locate and fix the baffle axially in the flue.

12. The water heater appliance of claim 10, wherein the flue collar is fixed to the baffle and mounted to an end of the flue.

13. The water heater appliance of claim 10, wherein the restrictors contact the flue and are configured for conductively transferring heat to the flue.

14. The water heater appliance of claim 13, wherein the conductive heat transfer from the restrictors heats water in the tank.

15. The water heater appliance of claim 10, further comprising an electrical heating element.

16. The water heater appliance of claim 15, wherein the baffle and the restrictors reduce stand-by heat loss when the water heater appliance is one or more of between cycles and heating via only the electrical heating element.

17. A water heater appliance for a recreational vehicle, comprising:

a tank comprising a cold-water inlet and a hot-water outlet;

an electrical heating element;

a flue disposed within the tank, the flue forming a U-shape extending to and from an external side of the tank;

a burner assembly disposed at an inlet of the flue; and a baffle disposed within the flue, the baffle comprising, a plurality of restrictors extending to the flue, and a flue collar configured to secure the baffle to the flue, wherein the baffle and the restrictors reduce stand-by heat loss when the water heater appliance is one or more of between cycles and heating via only the electrical heating element.

18. The water heater appliance of claim 17, wherein the baffle defines a helical shape and is configured to direct exhaust from the burner assembly in a spiral flow path through the flue.

19. The water heater appliance of claim 18, wherein the restrictors are arranged on the baffle and configured to locate and fix the baffle axially in the flue.

20. The water heater appliance of claim 17, wherein the flue collar is fixed to the baffle and mounted to an end of the flue.

* * * * *